US006939652B2

(12) United States Patent
Yu

(10) Patent No.: US 6,939,652 B2
(45) Date of Patent: Sep. 6, 2005

(54) FLEXIBLE ELECTROSTATOGRAPHIC IMAGING MEMBER

(75) Inventor: Robert C. U. Yu, Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/272,153

(22) Filed: Oct. 15, 2002

(65) Prior Publication Data

US 2004/0072088 A1 Apr. 15, 2004

(51) Int. Cl.[7] ..... G03G 5/10
(52) U.S. Cl. ..... 430/69; 430/127; 430/59.6
(58) Field of Search ..... 430/59.6, 69, 127

(56) References Cited

U.S. PATENT DOCUMENTS 4,265,990 A 5/1981 Stolka et al.
4,654,284 A * 3/1987 Yu et al. ..... 430/58.65
4,983,481 A * 1/1991 Yu ..... 430/56
5,021,309 A 6/1991 Yu
5,089,369 A 2/1992 Yu
5,167,987 A 12/1992 Yu
5,919,590 A 7/1999 Yu et al.
5,935,748 A 8/1999 Yu et al.
6,071,661 A * 6/2000 Hsieh et al. ..... 430/67
6,071,662 A 6/2000 Carmichael et al.
6,132,923 A 10/2000 Maty et al.
6,238,833 B1 * 5/2001 Chambers et al. ..... 430/96
6,261,730 B1 7/2001 Yanus et al.
6,303,254 B1 10/2001 Yu et al.
6,372,396 B1 4/2002 Yu et al.
2001/0001057 A1 * 5/2001 Melnyk et al. ..... 430/57.3

* cited by examiner

*Primary Examiner*—Christopher Rodee
(74) *Attorney, Agent, or Firm*—Nixon Peabody LLP

(57) ABSTRACT

The present invention relates to a flexible electrostatographic imaging member. The electrostatographic imaging member contains an optically transparent thermoplastic anti-curl back coating, which enables the imaging member to maintain desirable structural flatness, mechanical robustness, flexibility, longevity, and copy image qualities over extended use. The present invention also relates to a process of fabricating a flexible electrostatographic imaging member.

26 Claims, 1 Drawing Sheet

FLEXIBLE ELECTROSTATOGRAPHIC IMAGING MEMBER

FIELD

The present invention relates to the preparation of a flexible electrostatographic imaging member containing a thermoplastic anti-curl back layer. The present invention also relates to a process for making the flexible electrostatographic imaging member.

BACKGROUND

Flexible electrostatographic imaging members are well known in the art. Typical flexible electrostatographic imaging members include, for example: (1) electrophotographic imaging member belts (photoreceptors) commonly utilized in electrophotographic (xerographic) processing systems; (2) electroreceptors such as ionographic imaging member belts for electrographic imaging systems; and (3) intermediate toner image transfer members such as an intermediate toner image transferring belt which is used to remove the toner images from a photoreceptor surface and then transfer the very images onto a receiving paper. The flexible electrostatographic imaging members may be seamless or seamed belts. Typical electrophotographic imaging member belts include a charge transport layer and a charge generating layer on one side of a supporting substrate layer and an anti-curl back coating coated onto the opposite side of the substrate layer. A typical electrographic imaging member belt does, however, have a more simple material structure; it includes a dielectric imaging layer on one side of a supporting substrate and an anti-curl back coating on the opposite side of the substrate. Although the scope of the present invention covers the preparation of all types of flexible electrostatographic imaging members, for reason of simplicity, the discussion hereinafter will focus only on flexible electrophotographic imaging members.

Electrophotographic flexible imaging members may include a photoconductive layer including a single layer or composite layers. Since typical electrophotographic imaging members exhibit undesirable upward imaging member curling, an anti-curl back coating is required to offset the curl. Thus, the application of anti-curl back coating ("ACBC") is necessary to effect the appropriate imaging member flatness.

One type of composite photoconductive layer used in electrophotography is illustrated in U.S. Pat. No. 4,265,990, the entire disclosure of which is incorporated by reference herein, which describes a photosensitive member having at least two electrically operative layers. One layer includes a photoconductive layer which is capable of photogenerating holes and injecting the photogenerated holes into a contiguous charge transport layer. Generally, where the two electrically operative layers are supported on a conductive layer with the photoconductive layer sandwiched between the contiguous charge transport layer and the conductive layer, the outer surface of the charge transport layer is normally charged with a uniform charge of a negative polarity and the supporting electrode is utilized as an anode. Obviously, the supporting electrode may still function as an anode when the charge transport layer is sandwiched between the supporting electrode and the photoconductive layer. The charge transport layer in this latter embodiment must be capable of supporting the injection of photogenerated electrons from the photoconductive layer and transporting the electrons through the charge transport layer. Photosensitive members having at least two electrically operative layers, as disclosed above, provide excellent electrostatic latent images when charged with a uniform negative electrostatic charge, exposed to a light image and thereafter developed with finely divided electroscopic marking particles. The resulting toner image is usually transferred to a suitable receiving member such as paper.

As more advanced, higher speed electrophotographic copiers, duplicators and printers were developed, degradation of image quality was encountered during extended cycling. Moreover, complex, highly sophisticated duplicating and printing systems operating at very high speeds have placed stringent requirements, including narrow operating limits, on photoreceptors. For flexible electrophotographic imaging members having a belt configuration, the numerous layers found in modern photoconductive imaging members must be highly flexible, adhere well to adjacent layers, and exhibit predictable electrical characteristics within narrow operating limits to provide excellent toner images over many thousands of cycles. One type of multilayered photoreceptor that has been employed as a belt in negatively charging electrophotographic imaging systems includes a substrate support, a conductive layer, a hole blocking layer, an adhesive layer, a charge generating layer, a charge transport layer, and a conductive ground strip layer adjacent to one edge of the imaging layers. This photoreceptor belt also includes additional layers such as an anti-curl back coating to achieve the desired photoreceptor belt flatness.

In a machine service environment, a flexible imaging member belt, mounted on a belt supporting module, is generally exposed to repetitive electrophotographic image cycling which subjects the outer-most charge transport layer to mechanical fatigue as the imaging member belt bends and flexes over the belt drive roller and all other belt module support rollers, as well as sliding bend contact of the anti-curl back coating over all the belt module support rollers and against each backer bar's curving surface. This repetitive imaging member belt cycling leads to a gradual deterioration in the physical/mechanical integrity of the exposed outer anti-curl back coating below the belt and the charge transport layer on the top of the belt, leading to excessive anti-curl back coating wear, as well as causing premature onset of fatigue charge transport layer cracking. Anti-curl back coating wear results in a dirty machine environment with debris being deposited over the backer bar's surface to create high protrusion spots. These high protrusion spots then poke the back side of the imaging member belt during cyclic belt motion to further exacerbate and hasten the early onset of dynamic fatigue charge transport layer cracking. The cracks developed in the charge transport layer are found to manifest themselves into copy printout defects, which thereby adversely affect the image quality on the receiving paper. In essence, the appearance of charge transport cracking cuts short the imaging member belt's intended functional life.

When a production web stock of several thousand feet of coated multilayered photoreceptor is obtained after finishing the charge transport layer coating/drying process, it is seen to spontaneously curl upward toward the applied coating layers, and, therefore, requires an anti-curl back coating to be applied to the backside of the substrate support (i.e., opposite to the side having the charge transport layer) to offset the curl and render the desired photoreceptor web stock flatness. The exhibition of spontaneous upward photoreceptor web stock curling after completion of charge transport layer coating has been determined to be the consequence of thermal contraction mismatch between the applied charge transport layer and the substrate support under the conditions of elevated temperature heating/drying the solution applied wet coating and eventual cooling down to room ambient temperature. Since the charge transport layer in a typical prior art photoreceptor device has a coefficient of thermal contraction approximately 3½ times larger than that of the substrate support, it does, upon cooling down to room ambient temperature, result in greater dimensional contraction than that of the substrate support, causing upward photoreceptor curling which then requires the anti-curl back coating to balance the curling effect and provide photoreceptor flatness.

Seamed flexible photoreceptor belts are fabricated from rectangular sheets cut from an electrophotographic imaging member web stock having an anti-curl backing layer. The cut sheets are generally rectangular in shape. All edges may be of the same length or one pair of parallel edges may be longer than the other pair of parallel edges. The sheet is formed into a belt by joining the overlapping opposite marginal end regions of the sheet. A seam is typically produced in the overlapping opposite marginal end regions at the point of joining. Joining may be effected by any suitable means such as welding (including ultrasonic processes), gluing, taping, pressure/heat fusing, and the like. However, ultrasonic seam welding is generally the preferred method of joining because it is rapid, clean (no application of solvents) and produces a thin and narrow seam. The ultrasonic seam welding process involves a mechanical pounding action of a welding horn which generates a sufficient amount of heat energy at the contiguous overlapping marginal end regions of the imaging member sheet to maximize melting of one or more layers therein. A typical ultrasonic welding process is carried out by holding down the overlapping ends of the flexible imaging member sheet with vacuum onto a flat anvil and guiding the flat end of the ultrasonic vibrating horn transversely across the width of the sheet and directly over the overlapped junction to form a welded seam having excellent seam rupture strength and good belt flatness. A seamed flexible photoreceptor belt having good overall physical flatness, rendered by utilizing an anti-curl back coating, is of crucial importance; otherwise, under a dynamic belt functioning condition for a belt without the anti-curl back coating, upward belt curling will have significant surface distance variance to the machine charging devices causing non-uniform charge density dispensing on the photoreceptor belt surface to degrade copy printout quality. Moreover, photoreceptor belt upward curling will also physically interact/interfere with the xerographic subsystems, particularly, for example, in those machines employing a hybrid scavengeless development (HSD) or hybrid jumping development (HJD) subsystem, leading to undesirable artifacts which then manifest into printout defects in the final image copies.

Several earlier prior art references have disclosed successful fabrication of electrostatographic imaging members utilizing particularly selected support substrates for imaging member structural simplification without the need for an anti-curl back coating to render imaging member flatness. The particular substrates selected, such as polyether sulfone, polyvinyl fluoride, Makrofol, special formulated polyimide, amorphous polyethylene terephthalate, and the like, could provide curl-free imaging member devices, nevertheless the advantage gained by elimination of the anti-curl back coating was outweighed by the generation of some undesirable outcomes. For example, polyether sulfone and Makrofol used as an imaging member substrate support are susceptible to attack by the solvent used for the imaging layer coating solution, while polyvinyl chloride and amorphous polyethylene terephthalate both have low glass transition temperature (Tg) unable to withstand the high temperature exposure of the drying process for imaging member coatings of each layer, which during imaging member manufacturing, is elevated to about 130° C. The special polyimide substrate support is too expensive to justify its value for imaging member production implementation. In other words, the attempts to eliminate the need for an anti-curl back coating have been overcome by the creation of another set of undesirable problems.

With all the undesirables associated with the prior art mentioned above, it becomes clear that fabrication of flexible seamed photoreceptor belts having an anti-curl back coating is of crucial importance to render a photoreceptor belt with physical flatness for good machine functioning result as well as to eliminate the undesirable copy printout defects. The innovative formulation of an anti-curl back coating is necessary to have robust wear resistant properties to provide a clean imaging member belt machine function environment. Further, the anti-curl back coating formulation should be low cost so as to cut unit imaging member belt manufacturing cost.

U.S. Pat. No. 5,089,369, the entire disclosure of which is incorporated by reference herein, describes an electrophotographic imaging member having a supporting substrate and a charge generating layer, where the supporting substrate is made of a material having a thermal contraction coefficient which is substantially the same as that of the charge generating layer. Substrate materials having a thermal contraction coefficient value between about $5.0\times10^{-5}$/° C. and about $9.0\times10^{-5}$/° C. are preferred for use in combination with a benzimidazole perylene charge generating layer to resolve charge generation cracking problems and eliminate the need of an anti-curl back coating.

U.S. Pat. No. 5,167,987, the entire disclosure of which is incorporated by reference herein, describes a process for fabricating an electrostatographic imaging member including providing a flexible substrate including a solid thermoplastic polymer, forming an imaging layer coating including a film forming polymer on the substrate, heating the coating and substrate, cooling the coating and substrate, and applying sufficient predetermined biaxial tensions to the substrate while the imaging layer coating and substrate are at a temperature greater than the glass transition temperature of the imaging layer coating to substantially compensate for all dimensional thermal contraction mismatches between the substrate and the imaging layer coating during cooling of the imaging layer coating and the substrate, removing application of the biaxial tensions to the substrate, and cooling the substrate whereby the final hardened and cooled imaging layer coating and substrate are substantially free of internal stress and strain to yield a resulting curl-free imaging member without the need of an anti-curl back coating.

U.S. Pat. No. 4,983,481, the entire disclosure of which is incorporated by reference herein, describes an imaging member having improved resistance to curling without an anti-curl backing coating. The imaging member includes a flexible supporting substrate layer, an electrically conductive layer, an optional adhesive layer, a charge generating layer, and a charge transport layer, the supporting substrate layer having a thermal contraction coefficient substantially identical to the thermal contraction coefficient of the charge transport. The supporting substrate may be a flexible biaxially oriented layer.

While the above mentioned flexible imaging members may be suitable for their intended purposes to resolve specific problems and improve imaging member function, resolution of these problems have often created new ones. For example, supporting substrates such as polyether sulfone and Makrofol, which have thermal contraction coefficients closely matching that of the coated charge transport layer, are effective in keeping the electrophotographic imaging member from curling upward curling, but are oftentimes susceptible to attack and can be damaged by solvents used for the charge transport layer coating solution, thereby rendering the imaging member useless. Other prior art substrate supports, though having good thermal contraction coefficient matching properties such as Tedlar or Melinar, and thus yield curl-free electrophotographic imaging member without the need for an anti-curl back coating, inherently have low glass transition temperatures, Tg, and have been determined to be insufficient for imaging member fabrication. Moreover, another prior art disclosure of application of a biaxial tensioning stress onto imaging member, which was maintained at an elevated temperature slightly above the Tg of the charge transport layer to render imaging member flatness, was found to involve a cumbersome batch process, which process was deemed to be very costly to implement for imaging member production adaptation.

Since imaging member belt fabrication with total elimination of an anti-curl back coating still remains to be a conceptual idea that has been experimentally demonstrated in laboratory scale, it is yet far from being a production implemented manufacturing reality. Therefore, there is a continued need to improve the fabrication of imaging members, particularly providing it with a robust and low cost anti-curl back coating in the multilayered electrophotographic imaging member belt design that enhances the belt's machine mechanical performance.

SUMMARY

The present invention relates to a flexible electrostatographic imaging member. The flexible electrostatographic imaging members includes a substrate support, a multilayered photoimaging layer, and an optically transparent anti-curl back coating. The anti-curl back coating includes a thermoplastic polymer and having a glass transition temperature (Tg) value of at least about 75° C., a thermal contraction coefficient value of at least 1.5 times greater than the thermal contraction coefficient value of the substrate support, a Young's Modulus of at least about $2\times10^5$ pounds per square inch (p.s.i.), and a 180° peel strength value of at least about 15 grams/centimeter (g/cm).

The present invention also relates to a process for making a flexible electrostatographic imaging member. This process includes providing a substrate support having a first major surface and a second major surface. A multilayered photoimaging layer is applied to the substrate support's first major surface and an optically transparent anti-curl back layer is applied to the substrate support's second major surface.

Embodiments disclose providing an electrophotographic imaging member including a flexible substrate support layer coated over with an electrically conductive ground plane, a hole blocking layer, an optional adhesive layer, a charge generating layer, a charge transport layer, and an anti-curl back coating of the present invention. The anti-curl back coating has a thermal contraction coefficient value substantially greater than that of the substrate support used in the imaging member within a temperature range of between about 20° C. and about 130° C. To yield the imaging member flatness outcome, the applied anti-curl back coating has a thermal contraction coefficient of at least about 1.5 times greater than that of the substrate support to be satisfactory; that is a value at least approximately $+1\times10^{-5}$/° C. larger than the substrate support which is typically having an average substrate support thermal contraction coefficient of about $2\times10^{-5}$/° C. In one embodiment, the applied anti-curl back coating is at least about 2 times greater in thermal contraction coefficient than that of the substrate support, which is equivalent to about $+2\times10^{-5}$/° C. over that of the substrate support. More specifically, the applied anti-curl back coating may be a film forming thermoplastic polymer, be optically transparent, have good adhesion bonding to the substrate support, and have a Tg of at least about 75° C. The selected anti-curl back coating polymer is required to be conveniently dissolved in any common organic solvent for ease of coating solution preparation and is inexpensive, based on effectual imaging member production cost cutting consideration.

Flexible electrophotographic imaging member belts generally include a flexible supporting substrate having an electrically conductive surface layer which is subsequently coated over with an optional hole blocking layer, an optional adhesive layer, a charge generating layer, a charge transport layer, a ground strip layer, an optional overcoating layer, and an anti-curl back coating applied to the back side of the supporting substrate. The flexible substrate support is transparent and has a thickness of between about 25 micrometers and about 200 micrometers. A thickness in the range of from about 50 micrometers to about 125 micrometers gives optimum light transmission and substrate support layer beam rigidity result. The conductive surface layer coated over the flexible substrate support may include any suitable electrically conductive material such as, for example, aluminum, titanium, nickel, chromium, copper, brass, stainless steel, silver, carbon black, graphite, and the like. The electrically conductive surface layer coated above the flexible substrate support layer may vary in thickness over substantially wide ranges depending on the desired usage of the electrophotographic imaging member. However, from flexibility and partial light energy transmission considerations, it is, nonetheless, desirable that the conductive surface layer coated over the flexible substrate support be in a thickness range that provides sufficient light energy transmission of at least about 20% transmittancy to allow effective imaging member belt back erase.

DETAILED DESCRIPTION

Figure 1:
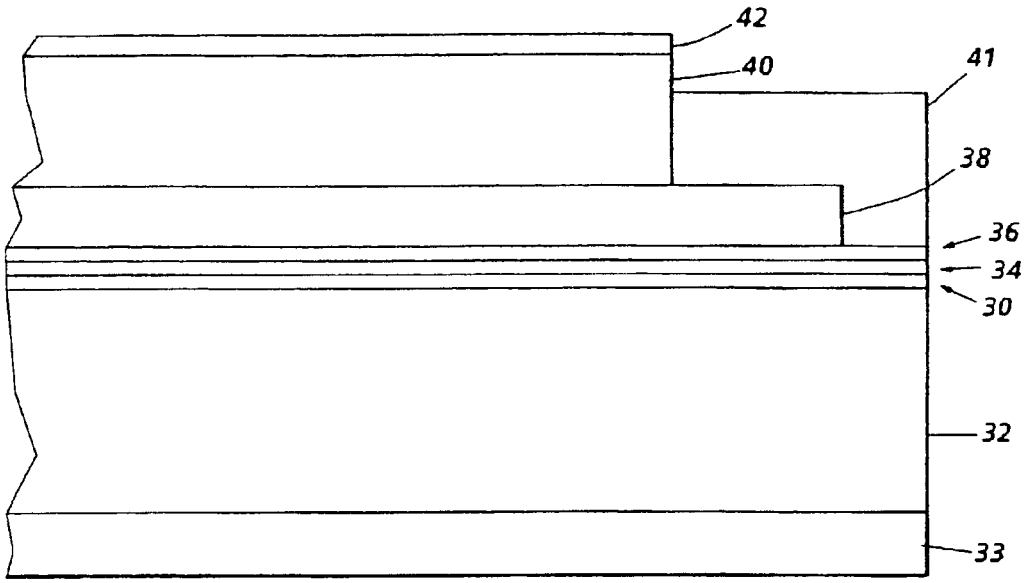
FIG. 1 is a schematic cross-sectional view of an exemplary embodiment of an imaging member of the present invention. This figure is merely a schematic representation based on convenience and the ease of demonstrating the present invention, and is, therefore, not intended to indicate relative size and dimensions of the imaging member or components thereof.

The present invention relates to a flexible electrostatographic imaging member. The flexible electrostatographic imaging member includes a substrate support, a multilayered photoimaging layer, and an optically transparent anti-curl back coating. The term optically transparent is defined herein as the capability of the anti-curl back coating to transmit at least about 98 percent of an incident light energy through the coating. The multilayered photoimaging layer may include a conductive layer, a hole blocking layer, a photogenerating layer, and a charge transport layer. The multilayered photoimaging layer may also include the following optional layers: an adhesive layer, an overcoat layer, and/or a ground strip layer. The anti-curl back coating includes a film forming thermoplastic polymer and has a glass transition temperature (Tg) value of at least about 75° C., a thermal contraction coefficient value of at least about 1.5 times greater than the thermal contraction coefficient value of the substrate support, a Young's Modulus of at least about $2\times10^5$ pounds per square inch (p.s.i.), and adheres well over the supporting substrate to give a 180° peel strength value of at least about 15 grams/centimeter (g/cm).

The present invention also relates to a process for making a flexible electrostatographic imaging member. This process involves providing a substrate support having a first major surface and a second major surface. A multilayered photoimaging layer is then applied to the substrate support's first major surface and an optically transparent anti-curl back coating is applied to the substrate support's second major surface.

For the sake of convenience, the invention will be described for electrophotographic imaging members in flexible belt form even though this invention includes electrostatographic imaging members of different material configurations.

An exemplary embodiment of the multilayered electrophotographic imaging member of flexible belt configuration of the present invention is illustrated in FIG. 1. In this figure, the thickness of the substrate support 32 depends on numerous factors, including mechanical strength, flexibility, and economical considerations; and thereby, this layer for a flexible belt may, for example, have a thickness of at least about 50 micrometers, or of a maximum thickness not greater than about 150 micrometers, provided there are no adverse effects on the final electrophotographic imaging device.

The substrate support 32 is not soluble in any of the solvents used in each coating layer solution, is optically transparent, and is thermally stable up to a high temperature of about 150° C. A typical substrate support 32 used for the prior art imaging member fabrication has a thermal contraction coefficient ranging from about $1\times10^{-5}$/° C. to about $3\times10^{-5}$/° C. and a Young's Modulus of between about $5\times10^5$ psi and about $7\times10^5$ psi.

The conductive layer 30 may vary in thickness over substantially wide ranges depending on the optical transparency and flexibility desired for the electrophotographic imaging member. Accordingly, when a flexible electrophotographic imaging belt is desired, the thickness of the conductive layer may be between about 20 Angstrom units and about 750 Angstrom units, and more specifically between about 50 Angstrom units and about 200 Angstrom units for an optimum combination of electrical conductivity, flexibility and light transmission. The conductive layer 30 may be an electrically conductive metal layer which may be formed, for example, on the substrate by any suitable coating technique, such as a vacuum depositing or sputtering technique. Typical metals suitable for use as conductive layer 30 include aluminum, zirconium, niobium, tantalum, vanadium, hafnium, titanium, nickel, stainless steel, chromium, tungsten, molybdenum, and the like. Where the entire substrate is an electrically conductive metal, the outer surface thereof can perform the function of an electrically conductive layer and a separate electrical conductive layer may be omitted.

After formation of an electrically conductive surface, a hole blocking layer 34 may be applied thereto. Generally, electron blocking layers for positively charged photoreceptors allow holes from the imaging surface of the photoreceptor to migrate toward the conductive layer. Any suitable blocking layer capable of forming an electronic barrier to holes between the adjacent photoconductive or photogenerating layer and the underlying conductive layer may be utilized. The hole blocking layer include nitrogen containing siloxanes or nitrogen containing titanium compounds as disclosed, for example, in U.S. Pat. Nos. 4,291,110, 4,338,387, 4,286,033 and 4,291,110, the disclosures of these patents being incorporated herein in their entirety. The blocking layer may be applied by any suitable conventional technique such as spraying, dip coating, draw bar coating, gravure coating, silk screening, air knife coating, reverse roll coating, vacuum deposition, chemical treatment and the like. The blocking layer should be continuous and more specifically have a thickness of less than about 0.2 micrometer.

An optional adhesive layer 36 may be applied to the hole blocking layer. Any suitable adhesive layer may be utilized. One well known adhesive layer includes a linear saturated copolyester reaction product of four diacids and ethylene glycol. This linear saturated copolyester consists of alternating monomer units of ethylene glycol and four randomly sequenced diacids in the above indicated ratio and has a weight average molecular weight of about 70,000 and a T~ of about 32° C. If desired, the adhesive layer may include a copolyester resin. The adhesive layer including the polyester resin is applied to the blocking layer. Any adhesive layer employed should be continuous and, more specifically, have a dry thickness between about 200 micrometers and about 900 micrometers and, even more specifically, between about 400 micrometers and about 700 micrometers. Any suitable solvent or solvent mixtures may be employed to form a coating solution of the polyester. Typical solvents include tetrahydrofuran, toluene, methylene chloride, cyclohexanone, and the like, and mixtures thereof. Any other suitable and conventional technique may be utilized to mix and thereafter apply the adhesive layer coating mixture of this invention to the charge blocking layer. Typical application techniques include spraying, dip coating, roll coating, wire wound rod coating, and the like. Drying of the deposited coating may be effected by any suitable conventional technique such as oven drying, infra red radiation drying, air drying, and the like.

Any suitable photogenerating layer 38 may be applied to the blocking layer 34 or adhesive layer 36, if one is employed, which can thereafter be overcoated with a contiguous hole transport layer 40 (also referred to herein as a "charge transport layer"). Examples of photogenerating layer materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigment such as the X-form of metal free phthalocyanine, metal phthalocyanines such as vanadyl phthalocyanine and copper phthalocyanine, quinacridones, dibromo anthanthrone pigments, benzimidazole perylene, substituted 2,4-diamino-triazines, polynuclear aromatic quinones, and the like dispersed in a film forming polymeric binder. Selenium, selenium alloy, benzimidazole perylene, and the like and mixtures thereof may be formed as a continuous, homogeneous photogenerating layer. Benzimidazole perylene compositions are well known and described, for example, in U.S. Pat. No. 4,587,189, the entire disclosure thereof being incorporated herein by reference. Multi-photogenerating layer compositions may be utilized where a photoconductive layer enhances or reduces the properties of the photogenerating layer. Other suitable photogenerating materials known in the art may also be utilized, if desired. Any suitable charge generating binder layer including photoconductive particles dispersed in a film forming binder may be utilized. For the charge generating binder layer, photoconductive particles such as vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof are appropriate because of their sensitivity to white light. Vanadyl phthalocyanine, metal free phthalocyanine and tellurium alloys are also useful because these materials provide the additional benefit of being sensitive to infrared light. The photogenerating materials selected should be sensitive to activating radiation having a wavelength between about about 600 and about 700 nm during the imagewise radiation exposure step in a electrophotographic imaging process to form an electrostatic latent image.

Any suitable inactive resin materials may be employed in the photogenerating layer 38 including those described, for example, in U.S. Pat. No. 3,121,006, the entire disclosure thereof being incorporated herein by reference. Typical organic resinous binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloridevinyichloride copolymers, vinylacetate-vinylidenechloride copolymers, styrene-alkyd resins, and the like.

The photogenerating composition or pigment can be present in the resinous binder composition in various amounts. Generally, from about 5 percent by volume to about 90 percent by volume of the photogenerating pigment is dispersed in about 10 percent by volume to about 95 percent by volume of the resinous binder, and more specifically from about 20 percent by volume to about 30 percent by volume of the photogenerating pigment is dispersed in about 70 percent by volume to about 80 percent by volume of the resinous binder composition.

The photogenerating layer containing photoconductive compositions and/or pigments and the resinous binder material generally ranges in thickness of from about 0.1 micrometer to about 5 micrometers, and more specifically has a thickness of from about 0.3 micrometer to about 3 micrometers. The photogenerating layer thickness is related to binder content. Higher binder content compositions generally require thicker layers for photogeneration. Thicknesses outside these ranges can be selected providing the objectives of the present invention are achieved.

The active charge transport layer 40 may include any suitable transparent organic polymer or non-polymeric material capable of supporting the injection of photogenerated holes and electrons from the trigonal selenium binder layer and capable of allowing the transport of these holes or electrons through the organic layer to selectively discharge the surface charge. The active charge transport layer 40 not only serves to transport holes or electrons, but also protects the photoconductive layer 38 from abrasion or chemical attack and therefore extends the operating life of the photoreceptor imaging member. The charge transport layer 40 should exhibit negligible, if any, discharge when exposed to a wavelength of light useful in xerography, e.g., about 4000 Angstroms to about 9000 Angstroms. Therefore, the charge transport layer is substantially transparent to radiation in a region in which the photoconductor is to be used. Thus, the active charge transport layer is a substantially non-photoconductive material which supports the injection of photogenerated holes from the generation layer. The active transport layer is normally transparent when exposure is effected through the active layer to ensure that most of the incident radiation is utilized by the underlying charge carrier generator layer for efficient photogeneration. The charge transport layer in conjunction with the generation layer in the instant invention is a material which is an insulator to the extent that an electrostatic charge placed on the transport layer is not conducted in the absence of illumination.

The active charge transport layer 40 may include any suitable activating compound useful as an additive dispersed in electrically inactive polymeric materials making these materials electrically active. These compounds may be added to polymeric materials which are incapable of supporting the injection of photogenerated holes from the generation material and incapable of allowing the transport of these holes therethrough. This will convert the electrically inactive polymeric material to a material capable of supporting the injection of photogenerated holes from the generation material and capable of allowing the transport of these holes through the active layer in order to discharge the surface charge on the active layer.

The charge transport layer 40 forming mixture may include an aromatic amine compound. One embodiment involves a charge transport layer employed in one of the two electrically operative layers in the multi-layer photoconductor of this invention includes from about 35 percent to about 45 percent by weight of at least one charge transporting aromatic amine compound, and about 65 percent to about 55 percent by weight of a polymeric film forming resin in which the aromatic amine is soluble. The substituents should be free form electron withdrawing groups such as $NO_2$ groups, CN groups, and the like. Typical aromatic amine compounds include, for example, triphenyl amine, bis(4-diethylamine-2-methylphenyl)phenylmethane; 4-4'-bis(diethylamino)-2', 2'-dimethyltriphenylmethane, N,N'-bis(alkylphenyl)-[1,1'-biphenyl]-4,4 '-diamine wherein the alkyl is, for example, methyl, ethyl, propyl, n-butyl, etc., N,N'-diphenyl-N,N'-bis (chlorophenyl)-[1,1'-biphenyl]-4,4'-diamine, N,N',bis-(4-methylphenyl)-N,N'-bis(4-ethylphenyl)-1,1'-3,3'-dimethylbiphenyl)-4,4'-diamine, and the like dispersed in an inactive resin binder.

Any suitable inactive resin binder soluble in methylene chloride, chlorobenzene or other suitable solvent may be employed in the process of this invention. Typical inactive resin binders include polycarbonate resin, polyvinylcarbazole, polyester, polyarylate, polyacrylate, polyether, polysulfone, and the like. Molecular weights can vary, for example, from about 20,000 to about 1,500,000.

Examples of electrophotographic imaging members having at least two electrically operative layers, including a charge generator layer and diamine containing transport layer, are disclosed in U.S. Pat. Nos. 4,265,990, 4,233,384, 4,306,008, 4,299,897 and 4,439,507, the disclosures thereof being incorporated herein in their entirety.

Any suitable and conventional technique may be utilized to mix and thereafter apply the charge transport layer 40 coating mixture onto the charge generating layer 38. Typical application techniques include spraying, roil coating, wire wound rod coating, and the like. Drying of the deposited coating may be effected by any suitable conventional technique such as oven drying, infra red radiation drying, air drying and the like. Generally, the thickness of the charge transport layer is between about 5 micrometers and about 100 micrometers, but thickness outside this range can also be used provided that there are no adverse effects.

The charge transport layer 40 should be an insulator to the extent that the electrostatic charge placed on the charge transport layer is not conducted in the absence of illumination at a rate sufficient to prevent formation and retention of an electrostatic latent image thereon. In general, the ratio of the thickness of the hole transport layer to the charge generator layer is more specifically maintained from about 2:1 to about 200:1 and in some instances as great as about 400:1.

The charge transport layer 40 is, generally, a solid solution including an activating organic compound molecularly dissolved in a polycarbonate binder of being either a poly(4,4'-isopropylidene diphenyl carbonate) or a poly(4,4'-diphenyl-1,1'-cyclohexane carbonate). Typically, it has a Young's Modulus in the range of from about $2.5\times10^5$ psi to about $4.5\times10^5$ psi and with a thermal contraction coefficient of between about $6\times10^{-5}$/° C. and about $8\times10^{-5}$/° C. Furthermore, the charge transport layer also has a glass transition temperature Tg of between about 75° C. and about 100° C.

Other layers such as conventional ground strip layer 41 including, for example, conductive particles dispersed in a film forming binder may be applied to one edge of the photoreceptor in contact with the conductive layer 30, hole blocking layer 34, adhesive layer 36 or charge generating layer 38. Ground strip layer 41 may include any suitable film forming polymer binder and electrically conductive particles. Typical ground strip materials include those enumerated in U.S. Pat. No. 4,664,995, the entire disclosure of which is incorporated by reference herein. The ground strip layer 41 may have a thickness from about 7 micrometers to about 42 micrometers, and more specifically from about 14 micrometers to about 23 micrometers.

Optionally, an overcoat layer 42, if desired, may also be utilized to provide imaging member surface protection as well as improve resistance to abrasion.

Since the charge transport layer 40 has a great thermal contraction mismatch compared to that of the substrate support 32, the prepared flexible electrophotographic imaging member is, at this point, seen to exhibit spontaneous upward curling due to the result of larger dimensional contraction in the charge transport layer 40 than the substrate support 32, as the imaging member cools down to room ambient temperature after the heating/drying processes of the applied wet charge transport layer coating. An anti-curl back coating 33 reformulated in the present invention is then necessary to be applied to the back side of the substrate support 32 (which is the side opposite the side bearing the electrically active coating layers) in order to render flatness.

The anti-curl back coating 33 may include any suitable organic or inorganic film forming polymers that are electrically insulating or slightly semi-conductive. In the embodiments of the present invention, the material make-up of the anti-curl back coating of the imaging member is reformulated to impact cost saving benefit as well as to provide mechanical robust belt function under normal electrophotographic imaging machine operational conditions.

The reformulated anti-curl back coating 33 of this invention has a thermal contraction coefficient value substantially greater than that of the substrate support 32 used in the imaging member within a temperature range between about 20° C. and about 130° C. employed during imaging member fabrication layer coating and drying processes. To yield the designed imaging member flatness outcome, the applied anti-curl back coating has a thermal contraction coefficient of at least about 1½ times greater than that of the substrate support to be considered satisfactory; that is a value of at least approximately $+1\times10^{-5}$/° C. larger than the substrate support which typically has a substrate support thermal contraction coefficient of about $2\times10^{-5}$/° C. However, an anti-curl back coating with a thermal contraction coefficient at least about 2 times greater, equivalent to about $+2\times10^{-5}$/° C., than that of the substrate support is appropriate to yield an effective anti-curling result. The applied anti-curl back coating of this invention is a film forming thermoplastic polymer, being optically transparent, with a Young's Modulus of at least about $2\times10^5$ psi, bonded to the substrate support to give at least about 15 gms/cm of 180° peel strength, and having a Tg of at least about 75° C. The anti-curl back coating is typically between about 7 and about 20 weight percent based on the total weight of the imaging member which corresponds to from about 7 to about 20 micrometers in coating thickness. The selected anti-curl back coating polymer is to be conveniently dissolved in any common organic solvent for the ease of coating solution preparation and is to be inexpensive, so as to provide effectual imaging member production cost cutting.

The selection of a thermoplastic film forming thermoplastic polymer for the invention anti-curl back coating application should satisfy the physical, mechanical, optical, and thermal requirements, as detailed herein. Suitable polymer materials for use in the anti-curl back coating include: polycarbonates, polystyrenes, polyesters, polyamides, polyurethanes, polyarylethers, polyarylsulfones, polyarylate, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloridevinylchloride copolymers, vinylacetate-vinylidenechloride copolymers, styrene-alkyd resins, and the like. These polymers may be block, random or alternating copolymers. In addition, other polymers may also include polycarbonate resin, polyvinylcarbazole, polyester, polyarylate, polyacrylate, polyether, polysulfone, polystyrene, polyamide, and the like. Molecular weights can vary from about 20,000 to about 150,000. Polycarbonates may be a bisphenol A polycarbonate material such as poly(4,4'-isopropylidene-diphenylene carbonate) having a molecular weight of from about 35,000 to about 40,000, available as Lexan 145 from General Electric Company and poly(4,4'-isopropylidene-diphenylene carbonate) having a molecular weight of from about 40,000 to about 45,000, available as Lexan 141 also from the General Electric Company. A bisphenol A polycarbonate resin having a molecular weight of from about 50,000 to about 120,000, is available as Makrolon from Farbenfabricken Bayer A.G. A lower molecular weight bisphenol A polycarbonate resin having a molecular weight of from about 20,000 to about 50,000 is available as Merlon from Mobay Chemical Company. Another type of polycarbonate of interest is poly(4,4-diphenyl-1,1'-cyclohexane carbonate), which is a film forming thermoplastic polymer structurally modified from bisphenol A polycarbonate; it is commercially available from Mitsubishi Chemicals. All of these polycarbonates have a Tg of between about 145° C. and about 165° C. and with a thermal contraction coefficient ranging from about $6.0\times10^{-5}$/° C. to about $7.0\times10^{-5}$/° C.

The anti-curl back coating may also be formed from a polymer blend including 2 or more compatible materials of any of the polymers listed above. Furthermore, suitable film forming thermoplastic polymers for the anti-curl back coating 33, if desired, may include the binder polymers used in the charge transport layer 40.

The anti-curl back coating formulations of the present invention may include the addition of a small quantity of a saturated copolyester adhesion promoter to enhance its adhesion bond strength to the substrate support. In one embodiment, the saturated copolyester adhesion promoter (1) has a linear or branched structure including organic diacids, ethylene glycols, and diols and (2) is generally described as poly(1,4-cyclohexylene-dimethylene terephthalate/isophthalate). Typical copolyester adhesion promoters are Vitel polyesters from Goodyear Rubber and Tire Company, Mor-Ester from Morton Chemicals, Eastar PETG from Eastman Chemicals, and the like. To impart optimum wear resistance as well as maintaining the coating layer optical clarity, the anti-curl back coating may also be incorporated into its material matrix, with about 5 to about 30 weight percent filler dispersion of silica particles, Teflon particles, $PVF_2$ particles, stearate particles, aluminum oxide particles, titanium dioxide particles or a particle blend dispersion of Teflon and any of these inorganic particles. Suitable particles used for dispersion in the anti-curl back coating include particles having a size of between about 0.05 and about 0.22 micrometers, and more specifically between about 0.18 and about 0.20 micrometers.

The fabricated multilayered, flexible electrophotographic imaging member having the present invention anti-curl back coating may be cut into rectangular sheets and converted into imaging member belts. The two opposite edges of each imaging member cut sheet are then brought together by overlapping and may be joined by any suitable means including ultrasonic welding, gluing, taping, stapling, and pressure and heat fusing to form a continuous imaging member seamed belt, sleeve, or cylinder, nevertheless, from the viewpoint of considerations such as ease of belt fabrication, short operation cycle time, and mechanical strength of the fabricated joint, the ultrasonic welding process is more specifically used to join the overlapping edges into a flexible imaging member seamed belt. The prepared flexible imaging belt may therefore be employed in any suitable and conventional electrophotographic imaging process which utilizes uniform charging prior to imagewise exposure to activating electromagnetic radiation. When the imaging surface of an electrophotographic member is uniformly charged with an electrostatic charge and imagewise exposed to activating electromagnetic radiation, conventional positive or reversal development techniques may be employed to form a marking material image on the imaging surface of the electrophotographic imaging member of this invention. Thus, by applying a suitable electrical bias and selecting toner having the appropriate polarity of electrical charge, one may form a toner image in the charged areas or discharged areas on the imaging surface of the electrophotographic member of the present invention. For example, for positive development, charged toner particles are attracted to the oppositely charged electrostatic areas of the imaging surface and for reversal development, charged toner particles are attracted to the discharged areas of the imaging surface.

As described above, the purpose of the anti-curl back coating is to provide desired flatness to the photoreceptor web stock. Selection of a favorable type of polymer material for use in the anti-curl back coating is important to achieve the desired flatness and durability of the imaging member. Therefore, in addition to its anti-curling properties, the anti-curl back coating more specifically satisfies a set of physical and mechanical requirements. For example, in one embodiment of the present invention, the anti-curl back coating layer: (1) is a film forming thermoplastic polymer having a Tg above the typical imaging machine operation temperature; (2) is readily soluble in a common organic solvent or a solvent mixture for ease of coating solution preparation; (3) has good optical clarity to allow the photoreceptor adequate radiation energy transmission for effective back erase during electrophotographic imaging processes; (4) is able to form good adhesion bond strength to the backside of the photorecptor substrate support without the possibility of layer delamination; (5) has excellent wear resistance against machine components mechanical interaction; (6) is at least about 1½ times greater in thermal contraction coefficient than that of the photoreceptor substrate support in temperature range, of between about 20° C. and about 130° C., to yield the desired anti-curling effect; however, a thermal contraction coefficient of at least 3 times greater than that of the substrate support gives the best result; and (7) is an inexpensive select polymer for the anti-curl back coating application to effect photoreceptor production cost efficiency.

The invention will further be illustrated in the following non-limiting examples, it being understood that these examples are intended to be illustrative only and that the invention is not intended to be limited to the materials, conditions, process parameters and the like recited herein. All proportions are by weight unless otherwise indicated.

EXAMPLES

Comparative Example A

A prior art flexible electrophotographic imaging member web stock, as that shown in FIG. 1, was prepared by providing a 0.01 micrometer thick titanium layer 30 coated on a flexible biaxially oriented Polyester substrate support 32, having a thermal contraction coefficient of $1.8\times10^{-5}$/° C., a glass transition temperature Tg of 130° C., and a thickness of 3 mils or 76.2 micrometers (Melinex 442, available from ICI Americas, Inc.). The titanium coated substrate support layer with an optical transmittancy of about 20 percent was adequately to effect back erase; and applying thereto, by a gravure coating process, a solution containing 10 grams gamma aminopropyltriethoxy silane, 10.1 grams distilled water, 3 grams acetic acid, 684.8 grams of 200 proof denatured alcohol and 200 grams heptane. This layer was then dried at 125° C. in a forced air oven. The resulting blocking layer 34 had an average dry thickness of 0.05 micrometer measured with an ellipsometer.

An adhesive interface layer 36 was then extrusion coated by applying to the blocking layer a wet coating containing 5 percent by weight based on the total weight of the solution of polyester adhesive (Mor-Ester 49,000, available from Morton International, Inc.) in a 70:30 volume ratio mixture of tetrahydrofuran/cyclohexanone. The resulting adhesive interface layer 34, after passing through an oven, had a dry thickness of 0.095 micrometer.

The adhesive interface layer 36 was thereafter coated, by extrusion, with a photogenerating layer containing 7.5 percent by volume trigonal selenium (Se), 25 percent by volume N,N'-diphenyl-N,N'-bis(3-methylphenyl)-1,1'-biphenyl-4,4'-diamine, and 67.5 percent by volume polyvinylcarbazole. This photogenerating layer 38 was prepared by introducing 8 grams polyvinyl carbazole and 140 milliliters of a 1:1 volume ratio of a mixture of tetrahydrofuran and toluene into a 20 ounce amber bottle. To this solution was added 8 grams of trigonal Se and 1,000 grams of ⅛ inch (3.2 millimeter) diameter stainless steel shot. This mixture was then placed on a ball mill for 72 to 96 hours. Subsequently, 50 grams of polyvinyl carbazole and 2.0 grams of N,N'-diphenyl-N,N'-bis(3-methylphenyl)-1,1'-biphenyl-4,4'-diamine was dissolved in 75 milliliters of 1:1 volume ratio of tetrahydrofuran/toluene. This slurry was then placed on a shaker for 10 minutes. The resulting slurry was thereafter extrusion coated onto the adhesive interface layer to form a coating layer having a wet thickness of 0.5 mil (12.7 micrometers). However, a strip about 10 millimeters wide along one edge of the substrate bearing the blocking layer 34 and the adhesive layer 36 was deliberately left uncoated by any of the photogenerating layer material to facilitate adequate electrical contact by a ground strip layer that was applied later. This photogenerating layer was dried at 125° C. to form a dry photogenerating layer 38 having a thickness of 2.0 micrometers.

This coated imaging member web was simultaneously extrusion overcoated with a charge transport layer 40 and a ground strip layer 41 using a 3 mil gap Bird applicator. The charge transport layer was prepared by introducing into an amber glass bottle a weight ratio of 1:1 N,N'-diphenyl-N,N'-bis(3-methylphenyl)-1,1'-biphenyl-4,4'-diamine and Makrolon 5705, a polycarbonate resin having a weight average molecular weight of about 120,000 commercially available from Farbensabricken Bayer A.G. The resulting mixture was dissolved to give a 15 percent by weight solids in 85 percent by weight methylene chloride. This solution was applied over the photogenerator layer 38 to form a coating which, upon drying, gave a charge transport layer 40 thickness of 24 micrometers and a thermal contraction coefficient of $6.5\times10^{-5}$/° C.

The approximately 10-millimeter wide strip of the adhesive layer left uncoated by the photogenerator layer was coated with a ground strip layer during a co-coating process. This ground strip layer 41, after drying at 125° C. in an oven, had a dried thickness of about 14 micrometers. This ground strip 41 (after converted into a seamed imaging member belt) was electrically grounded, by conventional means such as a carbon brush contact means during conventional imaging member belt xerographic imaging process.

The electrophotographic imaging member web stock, at this point if unrestrained, would spontaneously curl upwardly into a 1½ inch diameter tube. Therefore, the application of an anti-curl back layer 33 was required to provide the desired imaging member web flatness. A 13 micrometer thick typical prior art anti-curl back coating, which included 99 percent by weight Makrolon 5705 and 1 percent by weight Vitel PE-100 polyester adhesion promoter (available from Goodyear Rubber and Tire Company), was applied to the back side of the Melinex 442 substrate support to render the imaging member flatness.

Example I

A flexible electrophotographic imaging member web stock was prepared according to the procedures and using the same materials as those described in Comparative Example A, with the exception that a different anti-curl back coating was used to render the desired imaging member web flatness.

An anti-curl back coating solution was prepared by combining 8.82 grams of a polyphthalate carbonate resin (Lexan PPC 4701, available from General Electric Company), 0.72 gram of polyester resin (Vitel PE-200, available from Goodyear Tire and Rubber Company) and 90.1 grams of methylene chloride in a glass container to form a coating solution containing 8.9 percent by weight solids. The polyphthalate carbonate resin was a thermoplastic copolymer, with a thermal contraction coefficient of about $7.1\times10^{-5}$/° C., and a glass transition temperature (Tg) of about 170° C., and having a molecular formula of:

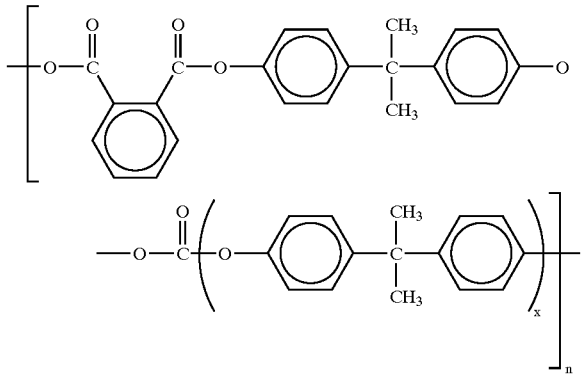

where x is an integer between about 1 and 10, and n is the degree of copolymerization.

The container with the polymeric solids in the solvent was covered tightly and placed on a roll mill for about 24 hours until the resin and polyester were dissolved in the methylene chloride to form the anti-curl back coating solution. The anti-curl back coating solution was then applied to the rear surface of the substrate (the side opposite the photoimaging layer) of the imaging member and dried at 135° C. to produce an optically transparent dried anti-curl back coating thickness of about 13.1 micrometers. The resulting electrophotographic imaging member web stock had the desired flatness and a structure as that schematically shown in FIG. 1.

Example II

A flexible electrophotographic imaging member web stock was prepared according to the procedures and using the same materials as those described in Example I, with the exception that the optically transparent anti-curl back coating used to provide the desired imaging member web stock flatness was a bisphenol A polycarbonate (Lexan 135 having a weight average molecular weight of about 47,000, available from General Electric Company). The thermoplastic polycarbonate had a thermal contraction coefficient of about $6.7\times10^{-5}$/° C. and a Tg of about 158° C.

Example III

A flexible electrophotographic imaging member web stock was prepared according to the procedures and using the same materials as those described in Example I, with the exception that the optically transparent anti-curl back coating used to provide the desired imaging member web stock flatness was another bisphenol A polycarbonate (Merlon 60 having a weight average molecular weight of about 34,000, available from Bayer AG). The thermoplastic polymer had a thermal contraction coefficient of about $6.9\times10^{-5}$/° C. and a Tg of about 151° C.

Example IV

A flexible electrophotographic imaging member web stock was prepared according to the procedures and using the same materials as those described in Example I, with the exception that the optically transparent anti-curl back coating used to provide the desired imaging member web stock flatness was Polyether Sulfone, (Victrex, available from ICI Americas, Inc). The thermoplastic Polyether Sulfone had a thermal contraction coefficient of about $6.0\times10^{-5}$/° C. and a Tg of about 220° C.

Example V

A flexible electrophotographic imaging member web stock was prepared according to the procedures and using the same materials as those described in Example I, with the exception that the optically transparent anti-curl back coating used to provide the desired imaging member web flatness was Polystyrene, available from Dow Chemicals Company. The thermoplastic Polystyrene had a thermal contraction coefficient of about $6.5\times10^{-5}$/° C. and a Tg of about 100° C.

Example VI

Four flexible electrophotographic imaging member web stocks were prepared according to the procedures and using the same materials as those described in Example I, with the exception that the optically transparent anti-curl back coating used to provide the imaging member the desired web stock flatness included 99, 98, 96, and 94 percent by weight Styrene Acrylonitrile thermoplastic copolymer (LUSTRAN 31, available from Bayer Corporation) and 1, 2, 3, and 6 percent by weight of poly(1,4-cyclohexylene-dimethylene terephthalate) Eastar PETG Copolyester 6763 (available from Eastman Chemical Company), respectively, for adhesion promotion. The thermoplastic copolymer had a thermal contraction coefficient of about $6.8\times10^{-5}$/° C. and a Tg of about 120° C.

Example VII

Four flexible electrophotographic imaging member web stocks were prepared according to the procedures and using the same materials as those described in Example I, with the exception that the optically transparent anti-curl back coating used to provide each imaging member the desired web stock flatness included 99, 98, 96, and 94 percent by weight Makrolon 5705 and 1, 2, 4, and 6 percent by weight Eastar PETG, respectively. The thermoplastic Makrolon had a weight average molecular weight of about 120,000 and a thermal contraction coefficient of about $6.5\times10^{-5}$/° C. and a Tg of about 156° C.

Example VIII

Three flexible electrophotographic imaging member web stocks were also prepared according to the procedures and using the same materials as those described in Example I, with the exception that the optically transparent anti-curl back coating used to provide the desired imaging member web stock flatness included either Polysulfone, Ardel Polyarylate, or Polyphenylene Sulfone (all available from Amoco Performance Products, Inc.). These thermoplastic Polymers had a thermal contraction coefficient in a range of between about $5\times10^{-5}$/° C. and about $8.0\times10^{-5}$/° C., and a Tg of from about 140° C. to about 220° C., to satisfy the present invention anti-curl back coating application requirements.

Example IX

Two flexible electrophotographic imaging member web stocks were prepared according to the exact procedures and using identical materials as that of Example I, except that an additional particulate composition was added in order to increase the wear resistance of the optically transparent anti-curl back coating. The particulate composition was added in an amount of 10 percent by weight and contained both organic and inorganic particulate matter. Specifically, the organic particulate matter included polytetrafluoroethylene (PTFE) particles (MP 1100, available from Dupont) and the inorganic particulate matter included amorphous silica particles (Aerosil 809, available from Degussa AG), each of which were dispersed in each of the anti-curl back coating layers of the two imaging members. An additional flexible imaging member web stock was also prepared, but the anti-curl back coating contained 10 percent weight dispersion of 1 to 1 weight ratio of silica/PTFE particles blend. The particle size of the PTFE dispersion in the anti-curl back coating was between about 0.19 and about 0.21 micrometer and had an average particle size of about 0.2 micrometer, where as the Aerosil silica particles ranged from about 500 to 900 Angstroms and an average particle size of about 600 Angstroms. Since the particles of both dispersions had a refractive index substantially matching that of the anti-curl polymer matrix, the presence of particles dispersion did not substantially impact the optical clarity of the resulting anti-curl back coating.

Mechanical Testing Example

The flexible electrophotographic imaging member web stocks prepared according to all of the above working Examples had optically transparent anti-curl back coatings by visual observation.

The electrophotographic imaging members of Comparative Example A and Examples I through VIII were assessed for adhesion bond strength onto the substrate support by 180° peel measurement. The 180° peel strength was determined by cutting a minimum of three 0.5 inch (1.2 cm)×6 inches (15.24 cm) samples from each imaging member of the Examples. For each sample, the anti-curl back coating was partially stripped from the test sample with the aid of a razor blade and then hand peeled to about 3.5 inches from one end to expose the underlying charge generating layer inside the sample. This stripped sample was then secured to a 1 inch (2.54 cm)×6 inches (15.24 cm) and 0.05 inch (0.254 cm) thick aluminum backing plate (having the charge transport layer facing the backing plate) with the aid of two sided adhesive tape. The end of the resulting assembly, opposite the end from which the anti-curl back coating was not stripped, was inserted into the upper jaw of an Instron Tensile Tester. The free end of the partially peeled anti-curl back coating was inserted into the lower jaw of the Instron Tensile Tester. The jaws were then activated at a one inch/min crosshead speed, with a two inch chart paper speed of a recorder, and a load range of 200 grams, to peel the sample at least two inches at an angle of 180°. The load record on the chart paper was used for calculating the peel strength of the sample. The peel strength was determined to be the load required to strip the anti-curl back coating off the substrate and then divided by the width (1.27 cm) of the test sample. The anti-curl back coating adhesion peel strength measurement result obtained for the prior art sample of Comparative Example A was 8.6 grams/cm, where as the peel strengths determined for all the Examples having invention anti-curl back coatings were all seen to be much greater than that of the prior art anti-curl back coating counterpart. It had also been found that the presence of particles dispersion was not seen to impact the peel strength of the anti-curl back coating. Furthermore, it was interesting to find that the loading level of copolyester adhesion promoter PETG had a strong impact on the 180° peel strength of the anti-curl back coatings of Examples VI and VII (see Table 1 below). As shown in Table 1, increasing the level of PETG in the anti-curl back coating could significantly affect an increase in peel strength of the anti-curl back coating (ACBC) to the substrate support.

TABLE 1

Adhesive Peel Strength Test Results for the Anti-Curl Back Coatings of Examples VI and VII

| Sample (ACBC Composition) | 180° Peel Strength (gm/cm) |
|---|---|
| Standard Control (92 Makrolon/8 Vitel PE-200) | 52.6 |
| Example VI (99 Makrolon/1 PETG) | 16.9 |
| Example VI (98 Makrolon/2 PETG) | 44.1 |
| Example VI (96 Makrolon/4 PETG) | 102.4 |
| Example VI (94 Makrolon/6 PETG) | 119.8 |
| Example VII (99 Lustran/1 PETG) | 32.2 |
| Example VII (98 Lustran/2 PETG) | 68.5 |
| Example VII (96 Lustran/4 PETG) | 154.7 |
| Example VII (94 Lustran/6 PETG) | 207.2 |

The flexible electrophotographic imaging member web stocks of Examples I and IX were evaluated for anti-curl back coating susceptibility to wear. For wear testing, each imaging member was cut to a size of 1 inch (2.54 cm) by 12 inches (30.48 cm); testing was effected by means of a dynamic mechanical cycling device in which glass tubes were skidded across the surface of the charge transport layer on each imaging member. More specifically, one end of the test sample was clamped to a stationary post and the sample was looped upwardly over three equally spaced horizontal glass tubes and then downwardly over a stationary guide tube through a generally inverted "U" shaped path with the free end of the sample secured to a weight which provided one pound per inch (0.17 kilogram per cm) width tension on the sample. The outer surface of the imaging member bearing the anti-curl back coating faced downwardly so that it would periodically be brought into sliding mechanical contact with the glass tubes. The glass tubes had a diameter of one inch (2.54 cm).

Each tube was secured at each end to an adjacent vertical surface of a pair of disks that were rotatable about a shaft connecting the centers of the disks. The glass tubes were parallel to and equidistant from each other and equidistant from the shaft connecting the centers of the disks. Although the disks were rotated about the shaft, each glass tube was rigidly secured to the disk to prevent rotation of the tubes around each individual tube axis. Thus, as the disk rotated about the shaft, two glass tubes were maintained at all times in sliding contact with the outer surface of the charge transport layer. The axis of each glass tube was positioned about 4 cm from the shaft. The direction of movement of the glass tubes along the anti-curl back coating surface was away from the weighted end of the sample toward the end clamped to the stationary post. Since there were three glass tubes in the test device, each complete rotation of the disk was equivalent to three wear cycles in which the surface of the anti-curl back coating was in sliding mechanical contact with a single stationary support tube during the testing. The rotation of the spinning disk was adjusted to provide the equivalent of 11.3 inches (28.7 cm.) per second tangential speed. The extent of anti-curl back coating wear was measured using a permascope at the end of a 330,000 wear cycles test. At a 10 percent by weight dispersion loading, the wear resistance of the overall anti-curl back coating of the imaging members of Example IX was improved more than 475 times above that of the same anti-curl back coating of Example I, having only the thermoplastic layer, but without particles dispersion in its coating layer matrix. The wear testing results obtained also clearly established that the PTFE dispersion gave a slightly better, but practically insignificant, anti-curl back coating wear resistance enhancement than that of the silica dispersion counterpart, while the PTFE/silica particles blend dispersion produced the best, again slightly, wear resistant outcome.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications, variations, improvements, and substantial equivalents.

What is claimed is:

1. A flexible electrostatographic imaging member comprising:

a substrate support having a first and a second major surface, wherein said substrate support comprises a flexible biaxially oriented thermoplastic polyester having a thickness of between about 50 and about 150 micrometers and having a thermal contraction coefficient of between about $1\times10^{-5}$/° C. and about $3\times10^{-5}$/° C.;

a multilayered photoimaging layer on the first major surface of the substrate support; and an optically transparent anti-curl back coating on the second major surface of the substrate support, said anti-curl back coating comprising a film forming thermoplastic polymer and having a glass transition temperature (Tg) value of at least about 75° C., a thermal contraction coefficient value of at least about 1.5 times greater than the thermal contraction coefficient value of the substrate support, and a 180° peel strength value of at least about 15 grams/centimeter (g/cm), wherein said anti-curl back coating comprises either of the following:

(a) a thermoplastic polymer comprising a polyphthalate carbonate resin having a thermal contraction coefficient of about $7.1\times10^{-5}$/° C., a Tg value of about 170° C., and a molecular formula of:

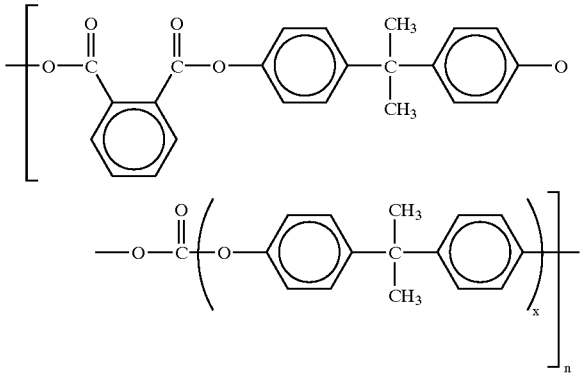

wherein x is an integer between about 1 and about 10, and n is the degree of copolymerization;

(b) a thermoplastic polymer comprising a polycarbonate resin having a thermal contraction coefficient of between about $6.0\times10^{-5}$/° C. and about $7.0\times10^{-5}$/° C. and a Tg value of between about 145 and about 165° C., wherein said polycarbonate resin is a polycarbonate of poly(4,4-diphenyl-1,1'-cyclohexane carbonate);

(c) a polyether sulfone thermoplastic polymer having a thermal contraction coefficient of about $6.0\times10^{-5}$/° C. and a Tg value of about 220° C.;

(d) a thermoplastic polystyrene having a thermal contraction coefficient of about $6.5\times10^{-5}$/° C. and a Tg value of about 100° C.;

(e) a styrene acrylonitrile thermoplastic copolymer having a thermal contraction coefficient of about $6.8\times10^{-5}$/° C. and a Tg value of about 120° C.;

(f) a thermoplastic polymer comprising from about 90 to about 99 percent by weight of styrene acrylonitrile thermoplastic copolymer and about 1 to about 10 percent by weight of a copolyester of poly(1,4-cyclohexylene-dimethylene terephthalate); or (g) a film forming thermoplastic polymer selected from the group consisting of polysulfone, polyarylate, and polyphenylene sulfone having a thermal contraction coefficient of between about $5.0\times10^{-5}$/° C. and about $8.0\times10^{-5}$/° C., and a Tg value of about between about 140 and about 220° C.

2. The imaging member according to claim 1, wherein said imaging member comprises from between about 7 and about 20 percent by weight, based on the total weight of the imaging member, of the anti-curl back coating.

3. The imaging member according to claim 1, wherein the anti-curl back coating has a thickness of between about 7 and about 20 micrometers.

4. The imaging member according to claim 1, wherein said anti-curl back coating comprises a thermoplastic polymer comprising a polyphthalate carbonate resin having a thermal contraction coefficient of about $7.1\times10^{-5}$/° C., a Tg value of about 170° C., and a molecular formula of:

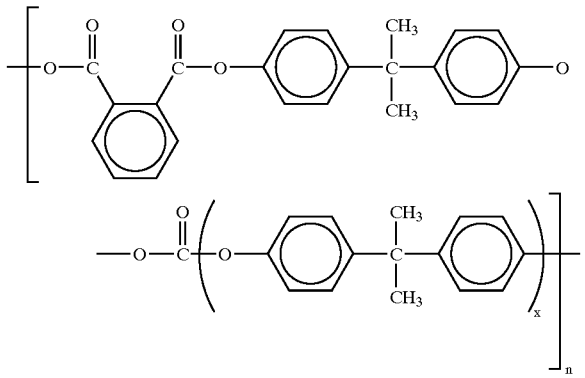

wherein x is an integer between about 1 and about 10, and n is the degree of copolymerization.

5. The imaging member according to claim 1, wherein said anti-curl back coating comprises a thermoplastic polymer comprising a polycarbonate resin having a thermal contraction coefficient of between about $6.0\times10^{-5}$/° C. and about $7.0\times10^{-5}$/° C. and a Tg value of between about 145 and about 165° C., wherein said polycarbonate resin is a polycarbonate of poly(4,4-diphenyl-1,1'-cyclohexane carbonate).

6. The imaging member according to claim 1, wherein said anti-curl back coating comprises a polyether sulfone thermoplastic polymer having a thermal contraction coefficient of about $6.0\times10^{-5}$/° C. and a Tg value of about 220° C.

7. The imaging member according to claim 1, wherein said anti-curl back coating comprises a thermoplastic polystyrene having a thermal contraction coefficient of about $6.5\times10^{-5}$/° C. and a Tg value of about 100° C.

8. The imaging member according to claim 1, wherein said anti-curl back coating comprises a styrene acrylonitrile thermoplastic copolymer having a thermal contraction coefficient of about $6.8\times10^{-5}$/° C. and a Tg value of about 120° C.

9. The imaging member according to claim 1, wherein said anti-curl back coating comprises from about 90 to about 99 percent by weight of styrene acrylonitrile thermoplastic copolymer and about 1 to about 10 percent by weight a copolyester of poly(1,4-cyclohexylene-dimethylene terephthalate).

10. The imaging member according to claim 1, wherein said anti-curl back coating comprises a film forming thermoplastic polymer selected from the group consisting of polysulfone, polyarylate, and polyphenylene sulfone having a thermal contraction coefficient of between about $5.0\times10^{-5}$/° C. and about $8.0\times10^{-5}$/° C., and a Tg value of about between about 140 and about 220° C.

11. The imaging member according to claim 1, wherein said anti-curl back coating further comprises between about 0.5 percent and about 10.0 percent by weight, based on the total weight of the anti-curl back coating, of dispersed particles selected from the group consisting of inorganic particles, organic particles, and mixtures thereof.

12. The imaging member according to claim 11, wherein said inorganic particles are selected from the group consisting of silica particles, aluminum oxide particles, and titanium dioxide particles, and wherein said organic particles are selected from the group consisting of polytetrafluoroethylene (PTFE) particles, $PVF_2$ particles, and stearates particles.

13. The imaging member according to claim 12, wherein said inorganic particles have a particle size distribution of between about 500 and about 900 Angstroms and wherein said organic particles have a particle size distribution of between about 0.18 and about 0.22 micrometers.

14. The imaging member according to claim 1, wherein said multilayered photoimaging layer comprises a conductive layer, hole blocking layer, a photogenerating layer, and a charge transport layer.

15. The imaging member according to claim 14, wherein said charge transport layer comprises a solid solution comprising an activating organic compound molecularly dissolved in a polycarbonate binder of either a poly(4,4'-isopropylidene diphenyl carbonate) or a poly(4,4'-diphenyl-1,1'-cyclohexane carbonate), said charge transport layer having a thermal contraction coefficient of between about $6\times10^{-5}$/° C. and about $8\times10^{-5}$/° C., and a Tg of between about 75° C. and about 100° C.

16. The imaging member according to claim 1, wherein said multilayered photoimaging layer further comprises at least one optional layer selected from the group consisting of an adhesive layer, an overcoating layer, and a ground strip layer.

17. A process for fabricating a flexible electrostatographic imaging member, said process comprising:

providing a substrate support having a first major surface and a second major surface, wherein said substrate support comprises a flexible biaxially oriented thermoplastic polyester having a thickness of between about 50 and about 150 micrometers and having a thermal contraction coefficient of between about $1\times10^{-5}$/° C. and about $3\times10^{-5}$/° C.;

applying a multilayered photoimaging layer to the substrate support's first major surface; and applying an optically transparent anti-curl back coating to the substrate support's second major surface, wherein said anti-curl back coating comprises a film forming thermoplastic polymer and has a glass transition temperature (Tg) value of at least about 75° C., a thermal contraction coefficient value of at least about 1.5 times greater than the thermal contraction coefficient value of the substrate support, and a 180° peel strength value of at least about 15 grams/centimeter (g/cm), and wherein said anti-curl back coating comprises either of the following:

(a) a thermoplastic polymer comprising a polyphthalate carbonate resin having a thermal contraction coefficient of about $7.1\times10^{-5}$/° C., a Tg value of about 170° C., and a molecular formula of:

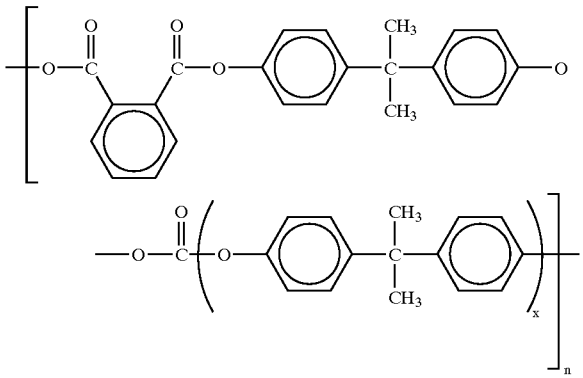

wherein x is an integer between about 1 and about 10, and n is the degree of copolymerization;

(b) a thermoplastic polymer comprising a polycarbonate resin having a thermal contraction coefficient of between about $6.0\times10^{-5}$/° C. and about $7.0\times10^{-5}$/° C. and a Tg value of between about 145 and about 165° C., wherein said polycarbonate resin is a polycarbonate of poly(4,4-diphenyl-1,1'-cyclohexane carbonate);

(c) a polyether sulfone thermoplastic polymer having a thermal contraction coefficient of about $6.0\times10^{-5}$/° C. and a Tg value of about 220° C.;

(d) a thermoplastic polystyrene having a thermal contraction coefficient of about $6.5\times10^{-5}$/° C. and a Tg value of about 100° C.;

(e) a styrene acrylonitrile thermoplastic copolymer having a thermal contraction coefficient of about $6.8\times10^{-5}$/° C. and a Tg value of about 120° C.;

(f) a thermoplastic polymer comprising from about 90 to about 99 percent by weight of styrene acrylonitrile thermoplastic copolymer and about 1 to about 10 percent by weight of a copolyester of poly(1,4-cyclohexylene-dimethylene terephthalate); or (g) a film forming thermoplastic polymer selected from the group consisting of polysulfone, polyarylate, and polyphenylene sulfone having a thermal contraction coefficient of between about $5.0\times10^{-5}$/° C. and about $8.0\times10^{-5}$/° C., and a Tg value of about between about 140 and about 220° C.

18. The process according to claim 17, wherein said multilayered photoimaging layer comprises a conductive layer, a hole blocking layer, a photogenerating layer, and a charge transport layer.

19. The process according to claim 17, wherein said multilayered photoimaging layer further comprises at least one optional layer selected from the group consisting of an adhesive layer, an overcoating layer, and a ground strip layer.

20. The process according to claim 17, wherein said anti-curl back coating comprises a thermoplastic polymer comprising a polyphthalate carbonate resin having a thermal contraction coefficient of about $7.1\times10^{-5}$/° C., a Tg value of about 170° C., and a molecular formula of:

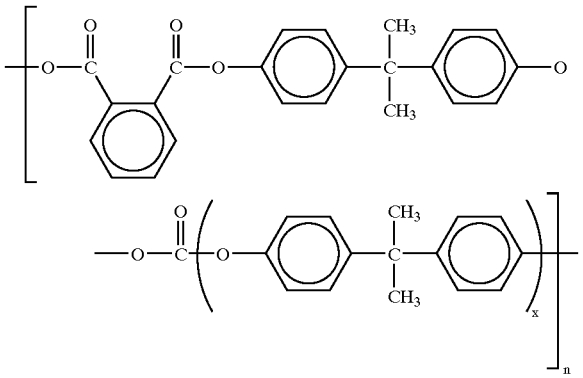

wherein x is an integer between about 1 and about 10, and n is the degree of copolymerization.

21. The process according to claim 17, wherein said anti-curl back coating comprises a thermoplastic polymer comprising a polycarbonate resin having a thermal contraction coefficient of between about $6.0\times10^{-5}$/° C. and about $7.0\times10^{-5}$/° C. and a Tg value of between about 145 and about 165° C., wherein said polycarbonate resin is a polycarbonate of poly(4,4-diphenyl-1,1'-cyclohexane carbonate).

22. The process according to claim 17, wherein said anti-curl back coating comprises a polyether sulfone thermoplastic polymer having a thermal contraction coefficient of about $6.0\times10^{-5}$/° C. and a Tg value of about 220° C.

23. The process according to claim 17, wherein said anti-curl back coating comprises a thermoplastic polystyrene having a thermal contraction coefficient of about $6.5\times10^{-5}$/° C. and a Tg value of about 100° C.

24. The process according to claim 17, wherein said anti-curl back coating comprises a styrene acrylonitrile thermoplastic copolymer having a thermal contraction coefficient of about $6.8\times10^{-5}$/° C. and a Tg value of about 120° C.

25. The process according to claim 17, wherein said anti-curl back coating comprises from about 90 to about 99 percent by weight of styrene acrylonitrile thermoplastic copolymer and about 1 to about 10 percent by weight a copolyester of poly(1,4-cyclohexylene-dimethylene terephthalate).

26. The process according to claim 17, wherein said anti-curl back coating comprises a film forming thermoplastic polymer selected from the group consisting of polysulfone, polyarylate, and polyphenylene sulfone having a thermal contraction coefficient of between about $5.0\times10^{-5}$/° C. and about $8.0\times10^{-5}$/° C., and a Tg value of about between about 140 and about 22° C.

* * * * *